US012134840B2

(12) United States Patent
Konukoğlu et al.

(10) Patent No.: US 12,134,840 B2
(45) **Date of Patent: *Nov. 5, 2024**

(54) YARN COMPRISING A CORE AND A SHEATH

(71) Applicant: Sanko Tekstil Isletmeleri San. Ve Tic. A.S., Inegol-Bursa (TR)

(72) Inventors: Fatih Konukoğlu, Inegol-Bursa (TR); Erdogan Baris Özden, Inegol-Bursa (TR); Şeref Ağzikara, Inegol-Bursa (TR); Ertuğ Erkuş, Inegol-Bursa (TR); Mustafa Zeyrek, Inegol-Bursa (TR); Eşref Tuncer, Inegol-Bursa (TR); Sedat Demirbüken, Inegol-Bursa (TR); Erkan Evran, Inegol-Bursa (TR)

(73) Assignee: SANKO TEKSTILI ISLETMELERI SAN. VE TIC. A.S., Inegol-Bursa (TR)

( * ) Notice: Subject to any disclaimer, the term of this patent is extended or adjusted under 35 U.S.C. 154(b) by 0 days.

This patent is subject to a terminal disclaimer.

(21) Appl. No.: 16/524,450

(22) Filed: Jul. 29, 2019

(65) Prior Publication Data

US 2020/0032427 A1 Jan. 30, 2020

(30) Foreign Application Priority Data

Jul. 27, 2018 (EP) ..... 18186144

(51) Int. Cl.

| | |
|---|---|
| ***D02G 3/04*** | (2006.01) |
| ***D01F 8/14*** | (2006.01) |
| ***D02G 3/32*** | (2006.01) |

(52) U.S. Cl.

CPC ..... *D02G 3/04* (2013.01); *D01F 8/14* (2013.01); *D02G 3/32* (2013.01); *D10B 2401/061* (2013.01)

(58) Field of Classification Search

None

See application file for complete search history.

(56) References Cited

U.S. PATENT DOCUMENTS 3,153,838 A * 10/1964 Pinson, Jr. ..... D02G 3/326 28/166
3,367,095 A 2/1968 Field
4,024,895 A * 5/1977 Barron ..... B60C 9/0042 139/426 R (Continued)

FOREIGN PATENT DOCUMENTS

EP 2873758 * 5/2015
EP 2873758 A1 5/2015

(Continued)

OTHER PUBLICATIONS

International search report and written opinion issued by the EPO on Aug. 28, 2019 for PCT/EP2019/070393.

(Continued)

*Primary Examiner* — Shawn Mckinnon

(57) ABSTRACT

A composite yarn (1) having a core (2) and a sheath (3), preferably comprising staple fibers (3*a*), said core (2) comprising at least one polymeric core fiber (21), preferably a plurality of core fibers (21), made of polymeric material, wherein the total amount of the core fibers (21) is at least 35% by weight of the total weight of the composite yarn (1), and wherein the core fiber (21) and the sheath (3) are spun together.

23 Claims, 9 Drawing Sheets

(56) References Cited

U.S. PATENT DOCUMENTS

| | | | | |
|---|---|---|---|---|
| 4,134,882 | A | 1/1979 | Frankfort et al. | |
| 4,343,334 | A | 8/1982 | Schulze et al. | |
| 2008/0268734 | A1* | 10/2008 | Tharpe | D02G 3/328 57/226 |
| 2010/0256319 | A1 | 10/2010 | Pereira de Lacerda et al. | |
| 2012/0079802 | A1* | 4/2012 | Yenici | D02G 3/26 57/211 |
| 2013/0260129 | A1* | 10/2013 | Agzikara | D02G 3/326 428/221 |

FOREIGN PATENT DOCUMENTS

| | | | |
|---|---|---|---|
| GB | 809321 | A | 2/1959 |
| JP | 6346332 | A | 12/1994 |
| JP | 2012219405 | A | 11/2012 |
| WO | 9618762 | A1 | 6/1996 |
| WO | WO9618762 | * | 6/1996 |
| WO | 2012062480 | A2 | 5/2012 |
| WO | 2015081592 | A1 | 6/2015 |

OTHER PUBLICATIONS

Exploring Draw Texturized Yarn (DTY) a Comprehensive Guide| Oerlikon, downloaded from the Internet on Dec. 1, 2023 and concurrently cited in IDS (https://www.oerlikon.com/en/industries/polymer-processing/exploring-draw-texturized-yarn-dty-a-comprehensive-guide/.

* cited by examiner

YARN COMPRISING A CORE AND A SHEATH

This non-provisional application claims priority to and the benefit of European Application No. 18186144.4 filed on 27 Jul. 2018, the content of which is incorporated herein by reference in its entirety.

FIELD OF THE INVENTION

The present invention relates to composite yarns having a core and a sheath of fibers, wrapping, i.e. covering, the yarn(s) of the core. In greater details, the invention relates to yarns having a core and a sheath of fibers, the core including a plurality of core fibers and, preferably, also yarns having elastic properties. The yarns of the invention find application in particular in the production of casual, sport and comfort garments, including denim garments.

BACKGROUND OF THE INVENTION

Yarns having a core including polymeric filaments are known in the art. EP 3208371 discloses a yarn having a core that includes at least one elastic performance filament, most preferably a spandex and/or a lastol filament, and an inelastic control filament formed of a textured polymer or copolymer of a polyamide, a polyester, a polyolefin and mixtures thereof. According to EP'371, the textured control filament is loosely wrapped around the elastic filament.

US 2013/0260129 in the name of the present applicant, discloses a stretch yarn having a composite stretchable core and a cotton fibres sheath. The stretchable core comprises first and second filaments that each have different elastic properties, the first filament is an elastomer and the second filament is a polyester based (co)polymer with limited elasticity; the second, polyester based (co)polymer fiber is in the range of 60-90% (w/w) of the stretchable core.

US 2008/0318485 discloses core spun yarns with bi-component polyester filaments and an elastomeric fiber; to avoid grinning through of the elastic core, the polyester filaments include poly (trimethylene terephthalate) and either poly (ethylene terephthalate) or poly (tetramethylene terephthalate) and the elastomeric fiber is comprising spandex. The bi-component polyester filaments are drafted at a ratio of 1.01 to 1.30 and the elastomeric fiber is drafted at a ratio of 2.50 to 4.50 times the original length.

US 2008/0299855 discloses a core yarn having a textured monofilament core and a staple fiber sheath. The core has 2 to 20 denier and is twisted with the staple fibers.

A problem with known composite yarns, especially stretch yarns, having composite elastic core is that a high amount of cotton has to be used to avoid the so called "grin though", i.e. surfacing, of the core through the sheath of fibers. Using a high amount of staple fibers, particularly of cotton fibers, is a cost. In particular, to provide a good appearance of the fabric, it is known to use a certain number of long cotton fibers, which is expensive; also, the use of highly twisted short fibers may result in the yarn to become "curly", i.e. provided with undulations; this would in turn provide an unsatisfactory appearance to the fabric obtained from the yarn.

Another problem with the yarns of the known art is that the high amount of cotton is not environmentally-friendly, as it is needed a high amount of water in cotton growing, and also a high amount of water and energy is needed to dye cotton.

SUMMARY OF THE INVENTION

It is an aim of the present invention to solve the above mentioned problems and provide yarns and fabrics with a synthetic core having excellent appearance and low cost, and possibly also good or great elasticity, should elasticity be required.

A further aim is to provide a yarn having a synthetic core that is completely covered by the fibers sheath, preferably a cotton fibers sheath, without the core surfacing through the fibers, especially after use.

Another aim of the invention is to provide a yarn, and a fabric, having a soft hand and that is comfortable for the user. A further aim is to provide a yarn that is environmentally-friendly and inexpensive to manufacture.

These and other aims are obtained by means of the yarn, the article and the method according to one or more of the enclosed claims.

In particular, the present invention relates to a yarn, an article and a method according to the independent claims. Preferred aspects are mentioned in the dependent claims.

An aspect of the present invention relates to a composite yarn having a core and a sheath; the core comprises at least one, preferably a plurality of, fibers, made of polymeric material, and the total amount of the core fibers is at least 35% by weight of the total weight of the composite yarn. Preferred embodiments are object of the dependent claims.

According to an aspect, the core fibers have a linear density of 14 denier or less, preferably 10 denier or less, more preferably 0.2 to 8 denier. According to a possible embodiment, the denier of the core fibers is comprised between 2 and 8 denier. Preferred core fibers are filaments. Preferably there are at least 12 filaments in the core The core fibers preferably consists of non-elastomeric fibers; some of the non-elastomeric fibers of the core may be elastic. Elastomeric filaments can be added to the core and combined with the non-elastomeric core fibers. The above percentages of the core fibers thus refer only to the content of non-elastomeric fibers that are present in the core. In other words, the non-elastomeric fibers that are present in the core are at least 35% by weight of the total weight of the yarn.

The present invention provides that the composite yarn has less sheath fibers than a corresponding yarn according to the prior art. In more detail, the amount of sheath fibers used in the invention yarn can be about 30-40% less than the amount of sheath fibers required in a corresponding average yarn according to the prior art. The reduction in the quantity of sheath fibers results in a plurality of advantages, the first being the sustainability of the yarn production process. Namely, a yarn having less cotton content than the prior art results in saving water because less cotton is require, hence less water is used in cotton growing. Also, less dyestuff has to be used for the dyeing process, because a lower amount of cotton (or other sheath fibers) has to be dyed. In view of that, the drying process of the yarns is also shorter and requires less energy with respect to the prior art.

In addition, the yarn of the invention has a very good appearance, because there is substantially no surfacing of the core yarns, notwithstanding the higher amount of fibers used for the core. Additionally, it was found that it is possible to use a higher percentage of short fibers in the sheath than the known art (which used longer cotton fibers).

According to an aspect, the sheath may be 100% cotton. Other embodiments are possible where 10% to 90% of the sheath fibers are cotton fibers. The remaining part of the sheath may comprise other commercially available fibers. Cotton fibers may be regular cotton fibers, pre-consumer cotton fibers, or post-consumer cotton fibers. This results in saving water and in a greater sustainability.

Other fibers, different than cotton, can be used for the sheath. As an example, man made fibers (preferably cellulose-based) may be used, e.g. rayon and its variations (Modal, Lyocell, Cupro, Viscose). Natural fibers may be also used such as linen, hemp, rami, Kapok. According to a possible solution, animal fibers such as wool, silk, cashmere may be used as well.

It was surprisingly found that the twisting or spinning of the above disclosed core fibers with an amount of staple fibers results in a yarn having a core in which the twisted core fibers entrap, i.e. hold, a portion of the fibers used for the sheath. In particular, smaller filaments of the core provide for a better holding of the fibers of the sheath.

In particular, according to a preferred aspect, the composite core yarn is provided with a hairiness index according to ASTM5647 of the composite yarn 1 is preferably comprised between 1 and 20, more preferably between 5 and 20.

A garment obtained with hairy yarns has been found to be soft and comfortable. A preferred method to obtain hairy composite yarns is to use ring spinning or a siro spinning process (i.e. a ring spinning with two rovings sources for the sheath). It has also been found that ring (and siro) spinning provide softer yarns with respect e.g. to air jet spinning or open end spinning.

According to a possible aspect, the tenacity of the composite yarn is comprised between 10 and 25 cN/tex, more preferably less than 23 cN/tex, even more preferably less than 20 cN/tex. Tenacity is measured according to EN ISO 2062.

Elongation at break of the composite yarn is preferably comprised between 3% to 50%, more preferably for 15% to 35%, measured with EN ISO 2062.

Count of the composite yarn is preferably comprised between Ne 3/1 to Ne 100/1, more preferably between Ne 5/1 to Ne 80/1.

The invention also provides the following advantages in the production process.

Ball warping step: the break ratio of the rope of the fabric to be made can decreases by 10-20%, considering production of a million meters of yarns, and the problem of adhered pile will be reduced by 5-10%; the figure of broken end sent to the rope dye may decrease by 5%.

Rope dyeing step: the amount of water to be used for dyeing the fabric can be reduced by 30-45%; since the above mentioned water amount is lower, the amount of chemicals and dye to be used will be reduced by 5-35%; drying the yarn is easier and the amount of steam used can be reduced by 30-50%.

Rebeaming: the yarn has higher breaking strength, compared to a corresponding known yarn, having the same count, made from the same materials and having a higher percentage of cotton. For this reason, the $10^6$ break ratio can increase by 10-35%; the $10^6$ break ratio (i.e. the break ratio considered in the production of a million meter of yarns) can be reduced by 5-25% as a result of the higher yarn strength; yarn to yarn friction will decrease, which will reduce 15-30% of cotton-based breaks in reed region; the lost ends problem will be reduced because the yarn break decreases.

Sizing: yarn breaks that may occur in the sizing area due to yarn property can be reduced by 5-25%; with the reduction of the number of yarn breakages, the number of missing tips to the weaving section can be reduced by 10-20%; the amount of chemical used for the sizing step can also be reduced by 8-35%; the steam consumption to be used for yarn drying can be reduced by 30-50%; the fault score can decrease by 5-8% due to the decrease in flying fibers.

According to an aspect, the core fibers comprise at least one, preferably a plurality of filaments (i.e. continuous fibers). In preferred embodiments, all the core fibers are filaments; in some embodiments, however, the core may comprise also (or consist in) a bundle of staple fibers, typically obtained by cutting and combining filaments The continuous core fibers can be single filaments, a single bundle of filaments, or they can be filaments that were already combined to form one or more yarns. In particular, the filaments can be provided in the core as DTY yarns. As known, DTY stands for Draw Textured Yarn. Known DTY yarns are available on the market. As a result, according to an aspect, one or more DTY yarn(s) is/are used to provide the core of the composite yarn of the present invention.

According to a possible production process of a DTY yarn, a POY (partially oriented yarn) is fed to two different and subsequent shafts, rotating at different speeds, so that the POY is drawn. In particular, the speed of the second shaft is always higher by the factor of the necessary draw ratio for the particular yarn and process. A friction device, such as a set of rotating friction disks, placed between the shafts, apply a (false) twisting to the yarn. As a result, the yarn is simultaneously twisted and drawn. Between the shafts there may be also a yarn heater, which heats the yarn to a temperature where it can be thermo-set. Right after the heater, there is normally a cooling plate, which must cool the yarn to a substantially lower temperature in order to permanently thermo-set the twist. As the yarn is released from the second shaft, each single filament of the DTY yarn tries to assume the shape of a three-dimensional helix. The result is a voluminous bulked stretch yarn.

In other words, according to a preferred production process of a DTY yarn, the operations of a THUT (Twist-Heat Set-Untwist) are carried out continuously. The yarn is taken from the supply package and fed at controlled tension through the heating unit, through a false twist spindle or over a friction surface that is typically a stack of rotating discs called an aggregate, through a set of take-up rolls, and onto a take-up package. The twist is set into the yarn by the action of the heater tube and subsequently is removed after the spindle or aggregate resulting in a group of filaments with the potential to form helical springs. Other processes known in the art to obtain a DTY yarn are however possible.

Similarly, the cut filaments may be part of a single bundle, or they may be part of two or more bundles.

Preferably, the core fibers are textured. The texturing may occur individually for each filament or, more commonly, the filaments may be textured when they are part of a bundle of filaments. As an example, continuous fibers (i.e. filaments) or staple fibers (e.g. obtained by cutting filaments) can be used to form a yarn, and texturing can be carried out on such a yarn. In other words, a plurality of non-textured filaments can be used to form a yarn, and such a yarn can subsequently textured. The core fibers of this yarn falls within the definition of "textured fibers". Similarly, a plurality of (textured or non-textured) filaments can be cut into short (staple) fibers, and these short fibers can be used to produce a yarn, that is subsequently textured. The fibers of this yarn fall within the definition of "plurality of textured fibers".

The core fibers preferably consists of non-elastomeric fibers. Elastomeric filaments can be added to the core and combined with the non-elastomeric core fibers. As a result, according to possible embodiments, the core may comprise non elastomeric core fibers and further elastomeric filaments.

Non elastomeric yarns of the core may have elastic properties. As a result, the core of the composite yarn may comprise different filaments with elastic properties, that can be the non-elastomeric filaments (i.e. continuous core fibers) that are part of the core fibers, as well as elastomeric filaments.

With the wording "filaments having elastic properties" it is meant elastomeric filaments such as the filaments in elastane, and elastic, non-elastomeric, filaments (e.g. T400 filaments). Suitable elastomeric filaments have an elongation at break higher than 200%, preferably higher than 400%, typically comprised between 200% and 600%. The amount of elastomeric filaments may be in the range of 1%-20%, more preferably 1.5% to 10% of the total weight of the yarn. Filaments having elastic properties may be combined together. Preferred elastomeric filaments are elastane, polyurethane urea based fibers, lastol, Dow XLA. The filaments having elastic properties may be non-elastomeric filaments, preferably having elongation at break comprised between 15-50%. Preferred fibers for elastic non-elastomeric filaments are T400 (co-polymer of Polyester, elasto-multiester), PBT fibers, and other conjugate yarns such as PBT-PTT, PET-PTT and PET-PTMT. Total amount of filaments having elastic properties is 1-60% of the weight of the composite yarn, preferably 10-45%.

Preferred core fibers are synthetic fibers, such as PP, PET, PA6, and PA6,6.

The above mentioned elongation at break of non-elastomeric filaments may be measured with DIN ISO 2062, while elastomeric filaments may be tested with BISFA, test method for bare elastane yarns, Chapter 6. Non elastomeric filaments have recovery of at least 80%, preferably 93%, most preferably at least 96% or 97% or higher of the fiber". Recovery is measured with DIN 53835 part 3, with 0.2 cN/tex force and 3% elongation.

The elastomeric filaments suitable for use in the present invention are commercially available, e.g. under the trade mark Lycra, usually in the form of several filaments that have been extrude in a one-piece bundle of filaments attached together. In a preferred embodiment the elastomeric filaments are provided as a bundle of separated single filaments. More details on this type of elastomeric filaments are disclosed in co-pending applications EP19169983.4 as filed in the name of the present applicant. In brief, according to an aspect, a composite yarn comprises at least two "single" elastic filaments. With the definition according to which the elastic filaments are "single" it is meant that they are not part of the same elastic bundle of continuously connected filaments. It is in fact known that for elastic textile elements, an amount of filaments may be bundled together to produce the desired thickness. It is e.g. known that a yarn of spandex is a bundle of filaments, as spandex yarns may be composed of a plurality smaller individual filament that adhere one another because of the natural stickiness of their surface. On the contrary, with "single elastic filament" is meant a monofilament yarn. According to a possible aspect, the single elastic filaments may be loosely coupled one to the other so as to be separated (and become "single filaments") during subsequent process steps for preparing a yarn according to the invention.

Total count of the core is preferably comprised between From 5 den to 1000 den, preferably from 50 den to 300 den.

Elongation at break of the core is preferably comprised between 5% and 160%, preferably between 10% to 50%.

According to an aspect, the continuous core fibers and the elastomeric filaments are combined together at least at a plurality of connecting points, in a known way, and preferably by means of intermingling, twisting or co-extrusion. The elastomeric filament is preferably drafted or elongated before being combined with the core fibers, with a draft ratio that is comprised between 1.5 to 5.5, more preferably between 2.5 and 5.5.

According to an aspect, the continuous core fibers and the elastomeric filament(s) are connected together in a continuous or substantially continuous way by "co-extrusion" of the filaments, preferably in a tensioned condition. During "co-extrusion", also known as co-feeding, two (or more) bundles of fibers (in a tensioned state) are forced (fed together) through a restriction where the fibers attach together to such a degree that they remain attached also after exiting the restriction. The co-extruded filaments are preferably spun with the fibers of the sheath immediately after the co-extrusion step According to an aspect, the core comprises at least 1, more preferably at least 12, more preferably at least 15 continuous core fibers, i.e. core filaments.

In embodiments of the invention, the amount of the core fibers (excluding the elastomeric fibers) is at least 35% by weight of the total weight of the yarn, i.e. of the complete yarn including the sheath, and may be as high as 90% of the weight of the complete yarn. Preferably, the amount of core fibers is at least 37 or 38% by weight of the final yarn; preferably the amount of core fibers is in the range of 35% to 73% by weight of the final yarn, more preferably, the core is in the range of 37% to 53%, or 38% to 49%, of the weight of the According to an aspect, the core fibers are made from one or more materials selected from polypropylene, polyester polymers and copolymers, polyamide polymers and copolymers and mixture thereof.

According to an aspect, the twist multiple of the composite yarn is in the range of 1.2 to 3.5, preferably in the range of 1.6 to 3.3, and more preferably in the range of 2.2 to 2.9.

In particular, the twisting of the composite yarn helps in combining the fibers of the sheath with the core. This helps in reducing the amount of sheath fibers that are needed to cover the core, preventing the above mentioned "grin through" of the filaments of the core. Also, short fibers may be used to obtain a composite yarn providing a "fluffy" feeling for a user touching the composite yarns (in particular the wearer of a garment comprising the above discussed yarns).

The twist multiple may be obtained from the equation:

$$\text{Twist/inch} = \text{Twist Multiple} \times \sqrt{\text{English Cotton Number}}$$

where the value of twist per inch may be calculated with the equation $$\text{Twist/inch} = \text{spindle rpm}/\text{Yarn Delivery Speed}$$

An aspect of the present invention also relates to a fabric including a composite yarn according to one or more of the above mentioned aspects.

An aspect of the present invention also relates to an article including such a fabric, the article preferably being a garment.

An aspect of the present invention also relates to a method of preparing a composite yarn according to one or more of the above mentioned aspect, comprising the steps of providing a core comprising a plurality of core fibers, made of polymeric material; providing a sheath of inelastic staple fibers to cover the core; spinning together the filaments of the core and the staple fibers of the sheath. The total amount of the core fibers is at least 35% by weight of the total weight of the composite yarn.

With the wording "spinning" or "twisting" it is indicated a known process of combining a core with a sheath of staple fibers. The process includes positioning the core fibers on or adjacent to sliver or bundle of sheath fibers and twist the core with the fibers. As discussed, preferred spinning methods include ring spinning (also as siro spinning).

According to an aspect, the elastomeric filaments are drafted to a draft ratio between 1.5 and 5.5.

Exemplary and non-limiting embodiments are now discussed with reference to the following figures, wherein.

DETAILED DESCRIPTION OF EXEMPLARY EMBODIMENTS

Figure 1:
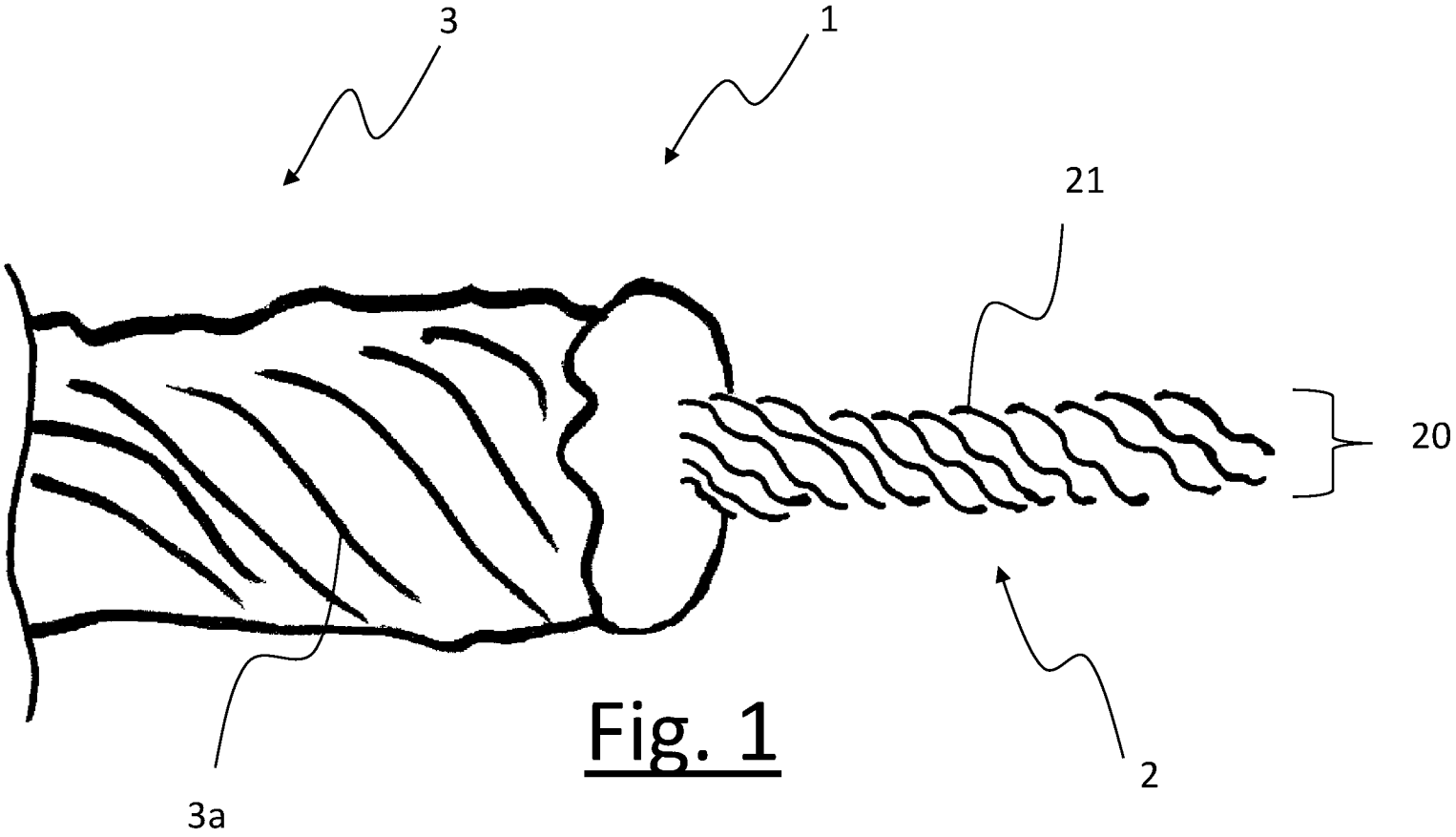
FIG. 1 is a schematic view of a composite yarn according to an embodiment of the present invention.

A composite yarn 1 has a core 2 and a sheath 3, typically comprising staple fibers 3*a*. The core 1 comprises at least one, and preferably a plurality of core fibers 21.

The core fibers 21 are preferably continuous fibers, i.e. filaments (as schematically shown in FIG. 1). In other embodiments, the core fibers 21 may comprise also (or consist in) a bundle of staple fibers obtained from cutting filaments. According to an embodiment, the core fibers 2 may comprise both filaments and a bundle of cut staple fibers.

The linear density of the core fibers 21 is preferably 14 denier or less, more preferably 10 denier or less, even more preferably 0.2 to 8 denier.

Preferred materials for the core fibers 21 are polyester polymers and copolymers. Other suitable polymers are polypropylene and polyamides. Exemplary materials for the core fibers 21 are polyester polymers and copolymers, namely PET (poly ethylene terephthalate), PBT (poly butylene terephthalate), PTT (Poly tri-methylene terephthalate) PTMT (poly tetra-methylene terephthalate) or copolymer of polyester PTT/PET, PTT/PBT, PTMT/PET. Exemplary polyamides (namely nylon) are: PA6 (polyamide) PA 6.6 or copolymers of nylon, and polyacrylic and polyacrylonitrile polymers. More preferred synthetic fibers for the core fibers are PP, PET, PA6, and PA6,6. The use of other synthetic materials, not explicitly mentioned in the above lists, for the core fibers is however not excluded. The core fibers are typically non-elastomeric, i.e. they do not comprise an elastomeric yarn.

Suitable staple fibers 3*a* to be used for providing the sheath 3 to the composite yarn 1 are known in the art and are e.g. cotton, rayon and its variation (Modal, Lyocell, Cupro, Viscose) linen, hemp, ramie, Kapok, wool, silk, cashmere, etcetera.

The amount of the core fibers 21 is at least 35% by weight of the total weight of the composite yarn 1.

In embodiments of the invention, the amount of the core fibers 21 is at least 35% by weight of the total weight of the composite yarn 1. In embodiments of the invention, the amount of the core fibers 21 may be as high as 90% of the weight of the composite yarn 1. Preferably, the amount of core fibers 21 is at least 37% or 38% by weight of the final composite yarn; preferably the amount of core fibers is in the range of 35% to 73% by weight of the final yarn, more preferably, the core is in the range of 37% to 53%, or 38% to 49%, of the weight of the yarn.

In the embodiment schematically shown in FIG. 1, the at least part of the core fibers may be provided as a bundle of fibers or as a core yarn 20, that may be a DTY yarn 20. Other embodiments are possible, e.g. embodiments where the core 2 comprises more than one DTY yarn. Furthermore, the core fibers 21 may be a generic bundle of core fibers, that are not part of a DTY yarn 20. Preferably, according to an aspect, the core 2 comprises continuous fibers, i.e. core filaments, and in particular at least 1 continuous core fiber, more preferably at least 12 continuous core fiber, even more preferably at least 15 continuous core fibers 21. The number of continuous filaments is preferably less than 1160.

The total count of the core is preferably comprised between, 5 and 1000 den, more preferably between 50 and 300 den. Elongation at break of each core fiber 21 is preferably comprised between 15 and 50%, elongation at break of the core yarn is preferably comprised between 5% and 160%, more preferably between 10% and 50%.

According to a possible embodiment, the core 2 (and thus the composite yarn 1) does not comprise any elastomeric yarn (see e.g. ASTM D4849 for definition of elastomeric yarn). In other words, the core 2 (and thus the composite yarn 1) essentially consist of non-elastomeric fibers. Some of these fibers may be elastic fibers.

According to different possible embodiments, the core 2 comprises at least one elastomeric filament 22. According to possible embodiments, the core 2 of the composite yarn 1 comprises at least two single elastic filaments 22, i.e. at least two different monofilament yarns.

Figure 2:
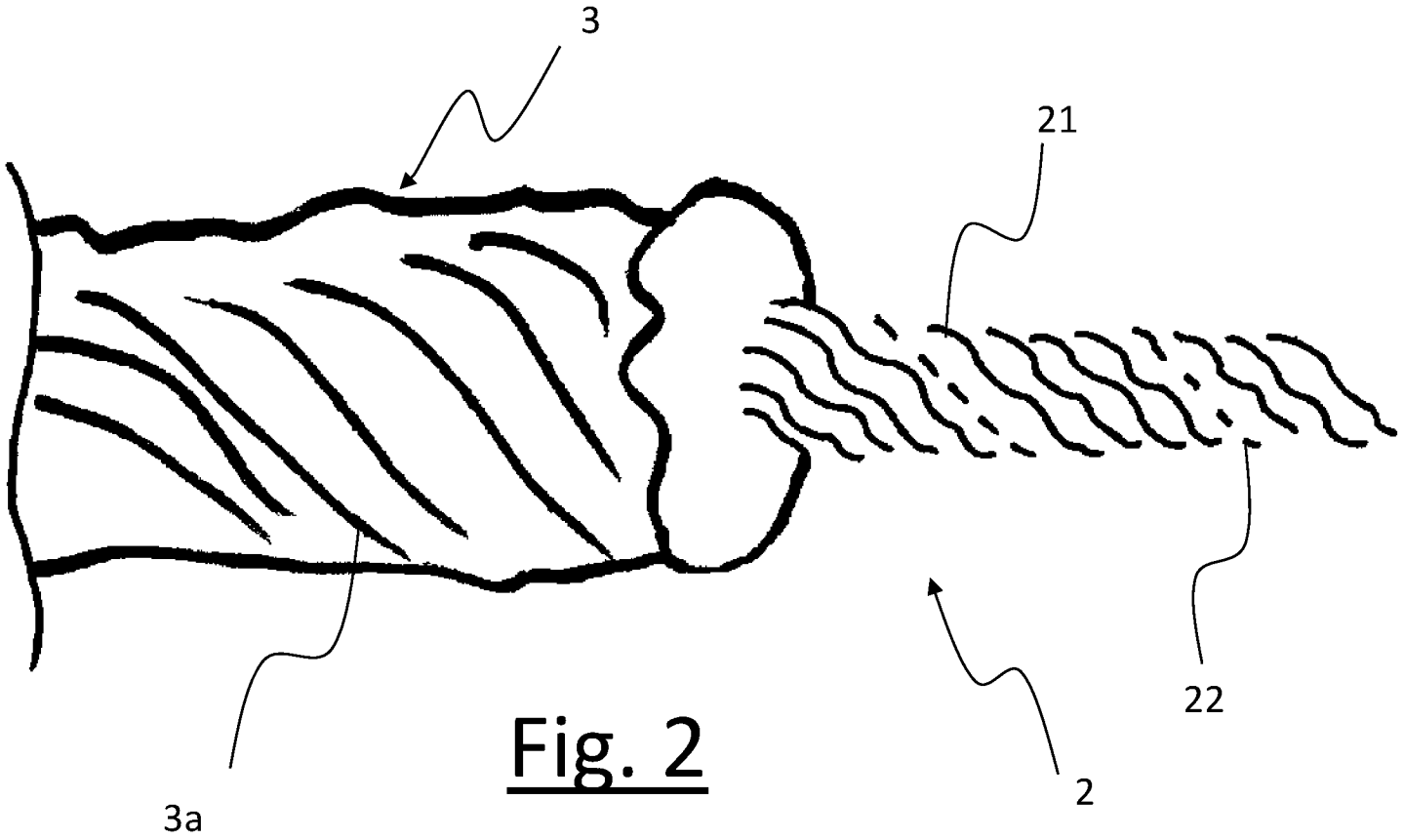
FIG. 2 is a schematic view of a composite yarn according to another embodiment of the present invention.

In the figures, an elastomeric filament 22 is shown in dotted lines in FIG. 2. This is done only to allow the reader to identify the elastomeric filament 22. The size and the arrangement of the elastomeric filament 22 in reality is not what is shown in the figures.

As discussed, the core fibers 21 may comprise non-elastomeric continuous fibers (i.e. non-elastomeric filaments); in addition, the core may further comprise elastomeric filaments 22. As a result, the core may comprise different filaments having elastic properties. As previously mentioned, the above discussed percentages ("at least 35%", "at least 37% or 38%", "in the range of 35% to 73", etc.) of the core fibers 21 refer to the non-elastomeric fibers that are present in the core 2. In other words, the non-elastomeric fibers of the core 2 (i.e. the core fibers 21) are at least 35% of the total weight of the composite yarn. Preferred ranges were previously discussed ("at least 37% or 38%", "in the range of 35% to 73", etc.).

The total count of filaments having elastic properties is preferably comprised between 5 and 500 den, more preferably between 20 and 240 den.

In embodiments of the invention, the core fibers 21 and the elastomeric filament(s) 22 are connected together at a plurality of points. Possible embodiments provide that the continuous core fibers 21 and the elastomeric filament(s) 22 are connected by intermingling, twisting or co-extrusion; these techniques are known in the art.

Figure 3:
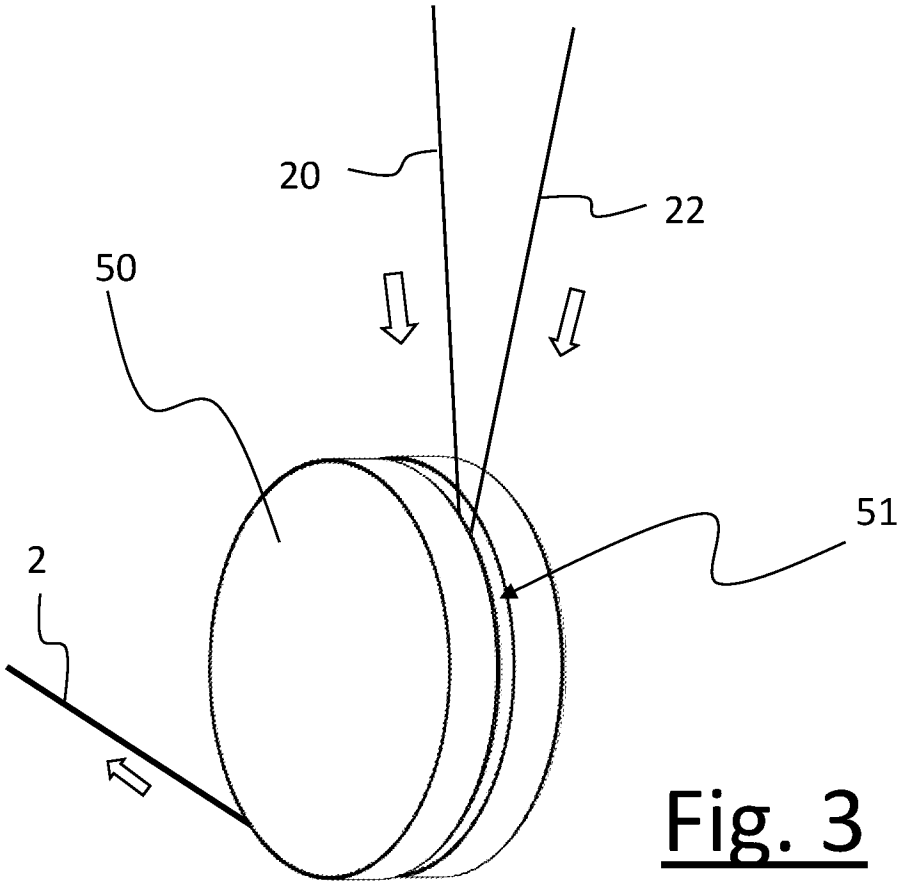
FIG. 3 is a schematic view of the "co-extrusion" method.

FIG. 3 schematically shows the "co-extrusion" or "co-feeding" method for a bundle of fibers or for a yarn 20 (e.g. a DTY yarn) and an elastomeric filament 22. For easiness, reference to a Dty yarn will be made, but the following description generally applies also to a texturized bundle of filaments. The DTY yarn 20 and the elastomeric filament 22 are fed (preferably in a tensioned state) through a restriction 51 where they are pressed together an attach to each other to such a degree that they remain attached also after exiting the restriction. In more detail, FIG. 3 shows a roll 50 having a "V"-shaped restriction 51; the DTY yarn 20 and the elastomeric filament 22 are fed to the roll 50 and are forced into the bottom of the "V" restriction 51, where they attach together, i.e. the DTY yarn 20 and the elastomeric filament 22 are connected together at least at a plurality of points, so that they exit the roll 50 as the substantially finished core 2, that may be covered by the sheath 3.

According to exemplary embodiments, the composite yarn 1 (i.e. the core 2 covered by the sheath 3) the twist level of the composite yarn 1 may be kept low with respect to the prior at. In more detail, the composite yarn is preferably twisted with twist multiples between 1.2 and 5.5, preferably between 1.2 and 3.5. It is even more preferred that the twist multiple be between 1.6 and 3.3, and even more preferable that the twist multiple be between 2.2 and 2.9. This low level twist results in a very soft fabric with excellent light reflection that is brilliant in color. As previously discussed, the twist multiple may be obtained from the equation:

$$\text{Twist/inch} = \text{Twist Multiple} \times \sqrt{\text{English Cotton Number}}$$

where the value of twist per inch may be calculated with the equation $$\text{Twist/inch} = \text{spindle rpm}/\text{Yarn Delivery Speed}$$

Further details on low-twist yarns and their method of production are available e.g. in EP 3064623, in the name of the present applicant, the teaching of said document being hereto incorporated by reference.

By using low twisting, it is possible to provide a coarser yarn, with respect to the prior art, i.e. a yarn that is bigger in dimension with respect to the prior art, as shown in the following comparative example.

Three yarns were prepared. Yarn A was a yarn according to the invention, while yarns B and C were 100% ring spun cotton yarn according to the prior art. Data of the yarn is as follows.

| YARN | Ring yarn Twist Multiple | composition of yarn | YARN NUMBER NE | Yarn diameter (mm) |
|---|---|---|---|---|
| A | 2.8 | 60.5% COTTON<br>39.5% POLYESTER | 14/1 | 0.425 |
| B | 4.5 | 100% COTTON | 14/1 | 0.340 |
| C | 4.5 | 100% COTTON | 8/1 | 0.470 |

As visible, yarn A according to the invention has a greater diameter than yarn B, i.e. a common 100% cotton yarn having the same count of yarn A (i.e. 14/1 NE). The diameter of yarn A is similar to the one of yarn C, i.e. a common 100% cotton yarn that is heavier than yarn A (14/1 NE vs 8/1 NE).

Diameter of the yarns was measured with USTER TESTER 4.

As previously discussed, a composite yarn 1 is typically soft. A possible factor that may help in providing a soft feeling may be the yarn hairiness.

A possible way to measure hairiness is disclosed in ASTM 5647. Hairiness index according to ASTM5647 of the composite yarn 1 is preferably comprised between 1 and 20, more preferably between 5 and 20. As known, the hairiness index H corresponds to the total length of protruding fibers within the measurement field of 1 cm length of the yarn.

According to a possible aspect, the tenacity of the composite yarn is comprised between 5 and 160 cN/tex, more preferably between 10 and 25 cN/tex, more preferably less than 23 cN/tex, more preferably less than 20 cN/tex. Tenacity is measured according to EN ISO 2062.

Elongation at break of the composite yarn 1 is preferably comprised between 3% to 50%, more preferably for 15% to 35%, measured with EN ISO 2062.

The count of the composite yarn is preferably comprised between Ne 3/1 to Ne 100/1, more preferably between Ne 5/1 to Ne 80/1.

A yarn of the invention may have a combination of the above features.

In general, during production of the composite yarn 1, a core comprising at least one, preferably, a plurality of core fibers 21 is provided. As mentioned, the core may also comprise an elastomeric filament 22.

The core fibers 21 and the elastomeric filament 22 are preferably coupled between each other at a plurality of points.

Figure 4A:
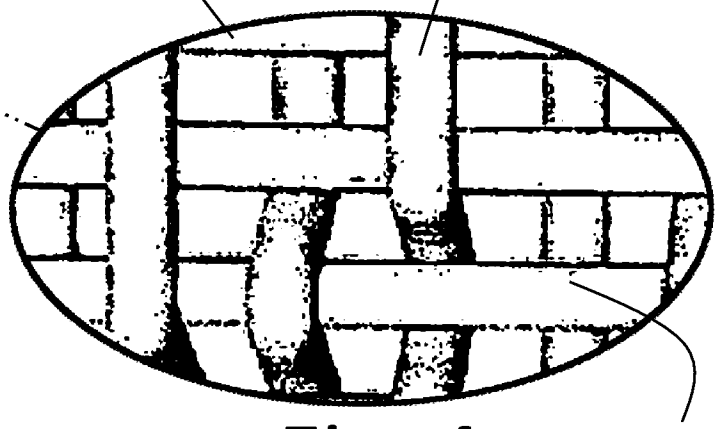
FIG. 4A is a schematic enlarged detail of FIG. 4.
Figure 4:
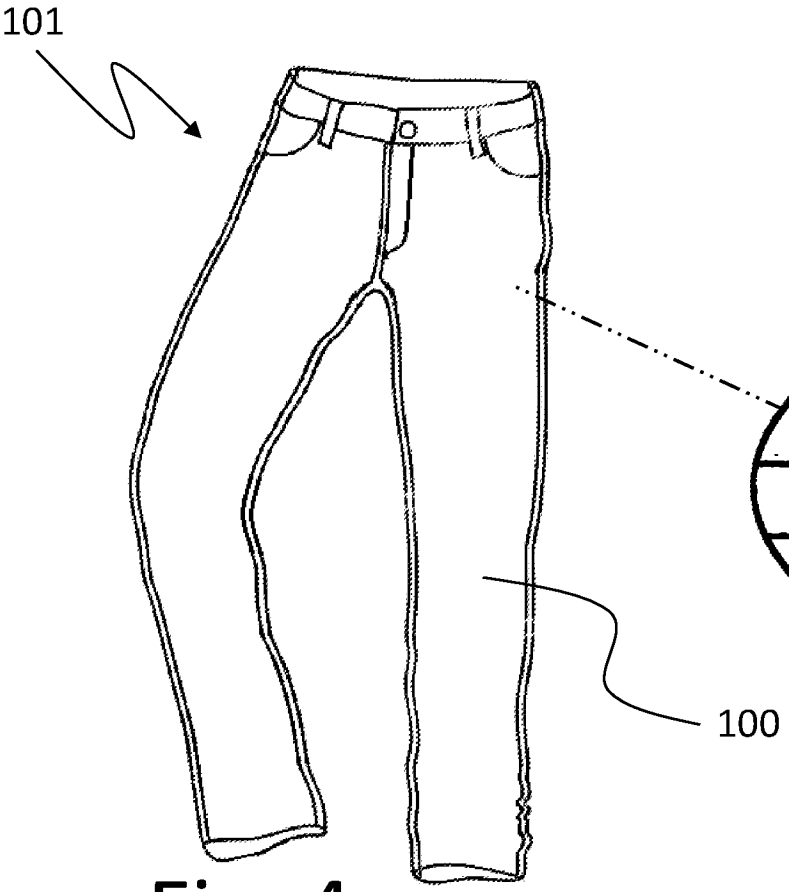
FIG. 4 is a schematic view of an article obtained with a fabric comprising composite yarns according to the present invention.

The continuous core fibers 21 and the elastomeric filament 22 may be connected together e.g. by intermingling, twisting, or (as schematically shown in FIG. 4), by "co-extrusion".

Once the core 2 is formed, it is covered, by known method, preferably via ring spinning or siro spinning, by the sheath 3.

In particular, the sheath 3 is provided so that, at the end of production, the weight of the core fibers 21 is at least 35% of the weight of the composite yarn 1.

At the end of production, the composite yarn 1 may be used to provide a fabric 100. The fabric 100 may be woven or knitted. The fabric 100 can be produced by using only the composite yarns 1 according to the present invention, or by combining the composite yarns 1 of the invention with different yarns.

Such a fabric 100 may be used to produce an article 101, that is preferably a garment. As an example, in FIG. 4, the composite yarns 1 are used in a woven denim fabric 100, that is in turn used to produce a pair of trousers.

Different treatments can be carried out on the final fabric 100. In one embodiment, the fabric 100 can be embossed to obtain a three-dimensional design.

A chemical treatment can be applied to the fabric to dissolve (part of) the cellulose fibers to obtain a design or pattern on the fabric 100. This technique is known in the art as "burnout" or "devoré".

Particular effects on the final fabric 100 can be obtained by using different colours between the core fibers and the sheath fibers.

In preferred embodiments, the composite yarn 1 is obtained via ring spinning. In particular, preferred embodiments provide that the composite yarn 1 is obtained by a core 2 that is coupled to a single roving (typically cotton roving). This provides a better centering (i.e. less grin through) of the core 2, and thus a softer and more appealing (in term of appearance) yarn. It is however possible to use two different rovings, as better discussed later.

Figure 5:
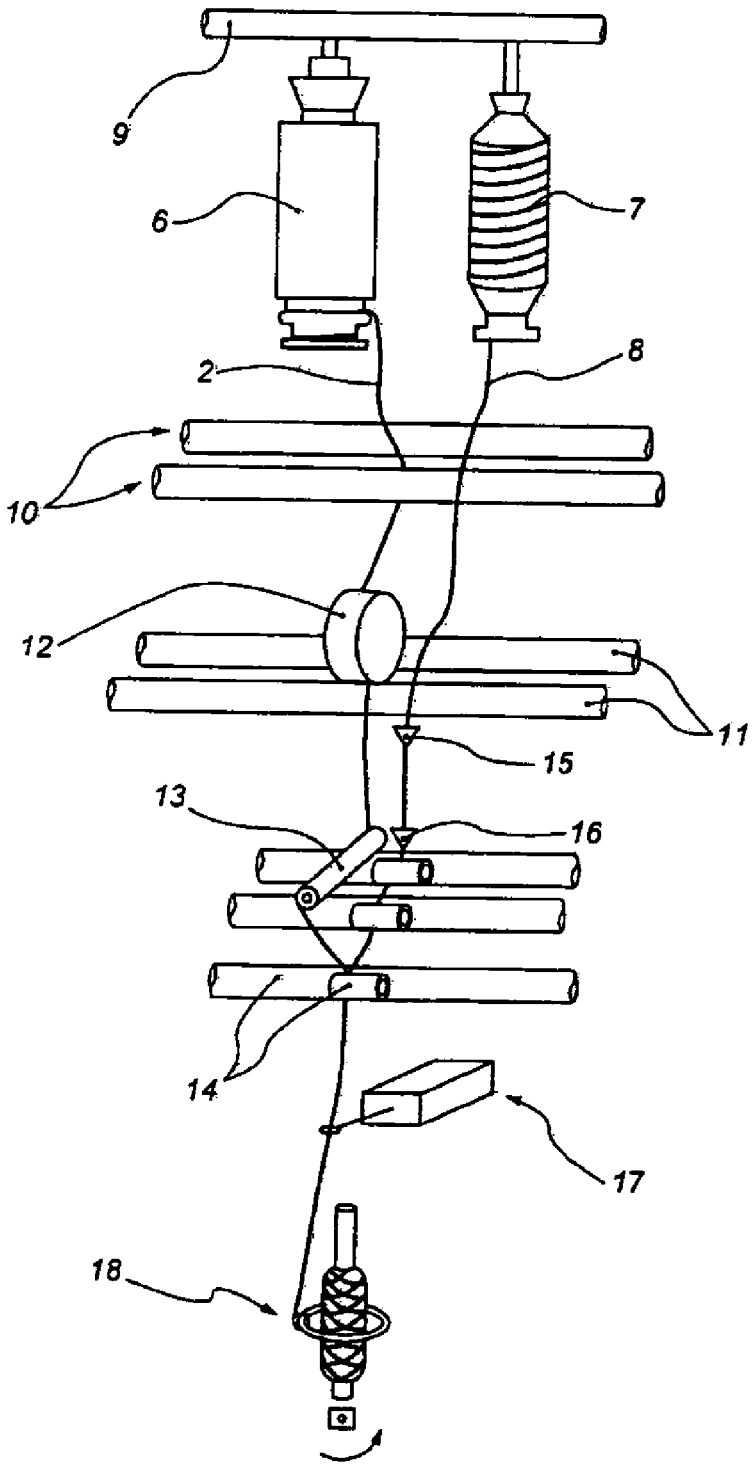
FIGS. 5 and 6 show a possible embodiment of an apparatus for the production of an exemplary composite yarn according to the invention.
Figure 6:
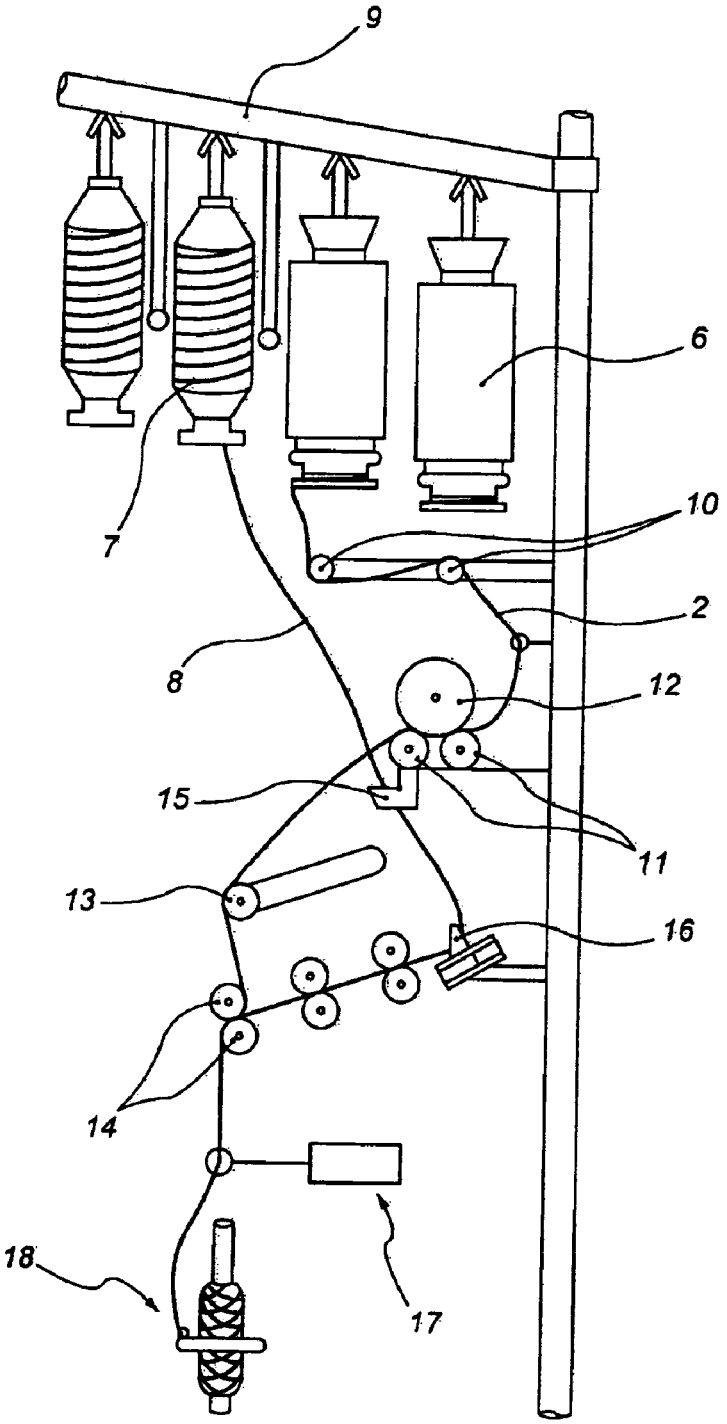

FIGS. 5 and 6 show an embodiment of a ring spinning apparatus for the production of an exemplary composite yarn 1 according to the invention.

The core 2 is provided as a bundle of fibers or yarn 20 taken from bobbin 6 and is guided between two tension bars 10 that are used to give a low pre-tension to the yarn, just to align and straighten bundle of fibers or core yarn 20. This is very useful when the core 2 is obtained by intermingling different filaments. From pre-tension bars 10, core 2 is fed to two driving rollers 11 on which a weight 12 is placed; core 2 is guided between the driving rollers and the weight 12 to avoid free movement of the core yarn with respect to the rollers 11, however, other suitable means for imparting a controlled speed to the bundle of fibers or yarn 20 may be used instead of the combination of rollers 11 and weight 12, e.g. means such as draft rollers that are known in the art.

The advantage of the above disclosed arrangement is mainly in the fact that the same apparatus can be used also to prepare a standard elastane core yarn: in this case the elastane fiber is loaded in a package that is placed on the rollers 11 in the place of weight 12.

From the first drafting arrangement 11, 12, core 2 (preferably a bundle of fibers or yarn 20, e.g. a DTY yarn) is guided to a rolling guide 13 and from it to draft rollers 14, that are the foremost couple of a plurality of drafting rollers for the cotton roving 8, known per se in the art.

Cotton roving 8 is guided from spool 7 in front of pre-tension rollers 10, tension rollers 11, into a first guide 15 and a second guide 16; as can be seen in FIG. 6, guide 15 is staggered to the front of the apparatus with respect to second guide 16 in order to create a tension in the roving and keep the roving in a fixed position, avoiding that the roving moves freely.

From guide 16, cotton roving 8 is sent to draft rollers 14. Draft rollers 14 are in common between core 2 and roving 8.

According to the invention, core 2 is tensioned before being coupled with the cotton roving, the tensioning or stretching is obtained by means of the speed difference between rollers 11 and rollers 14, i.e. the speed difference between rollers 11 and the last draft roller 14 create the draft ratio in composite core 2.

The above draft ratio is calculated as the ratio of the speed of rollers 14 vs. the speed of rollers 11, where the speed is the angular speed on the surface of the rollers.

It should be noticed that also pre-tensioning bars 10, contribute to obtaining the required draft ratio. The additional pretension bars 10 are useful in increasing the draft ratio because they provide an alignment and slight tension of the core 2, thus helping in the further stretch step. This results in the extreme accuracy with which the core 2 is kept in the center of the final yarn 1.

Use of additional guide 15 and its staggered position with respect of guide 16 also allow to feed the cotton roving always at the same position and to prevent the moving of cotton roving during the long run production. The combination of a better control in keeping the position of cotton roving 8 and a high tension on core 2 makes it possible to keep core 2 always in the center of the composite yarn 1 and to perfectly cover the core with staple fibers 3.

The two portions of final yarn 1 leaving draft rollers 14 are fed through guide 17 and spun together at spinning device 18, known per se in the art and comprising in one embodiment ring, traveler and spindle.

The composite yarn produced can be used in production of elastic denim fabric and garments, especially as weft yarn. Machinery and methods of producing denim are well known in the art, as an example, Morrison Textile Machinery or Sulzer Machinery or modifications thereof may be used to produce a denim fabric with great elasticity and excellent stretch recovery.

Figure 7:
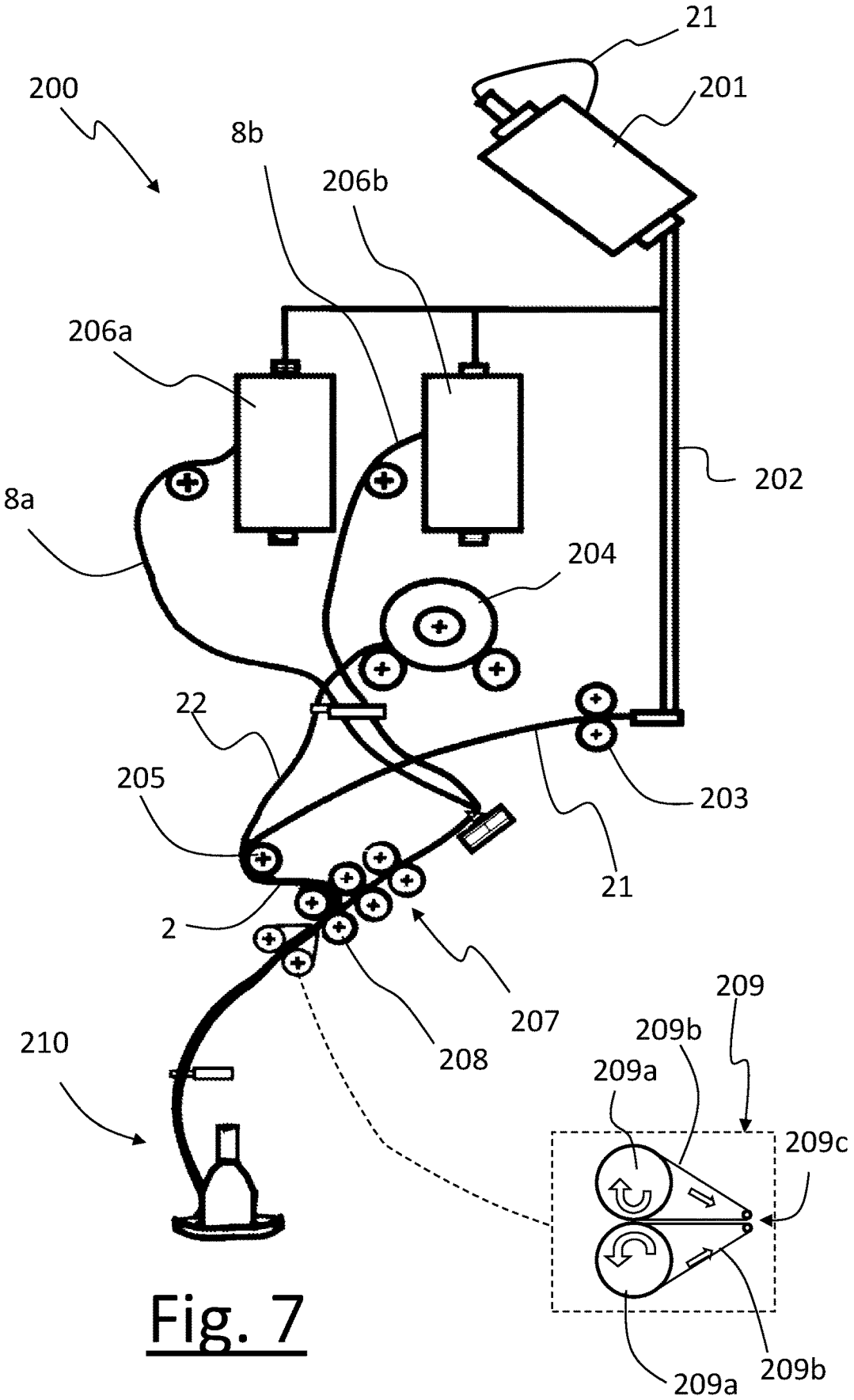
FIGS. 7 and 8 show another possible apparatus for the production of a composite yarn according to an embodiment of the present invention.
Figure 8:
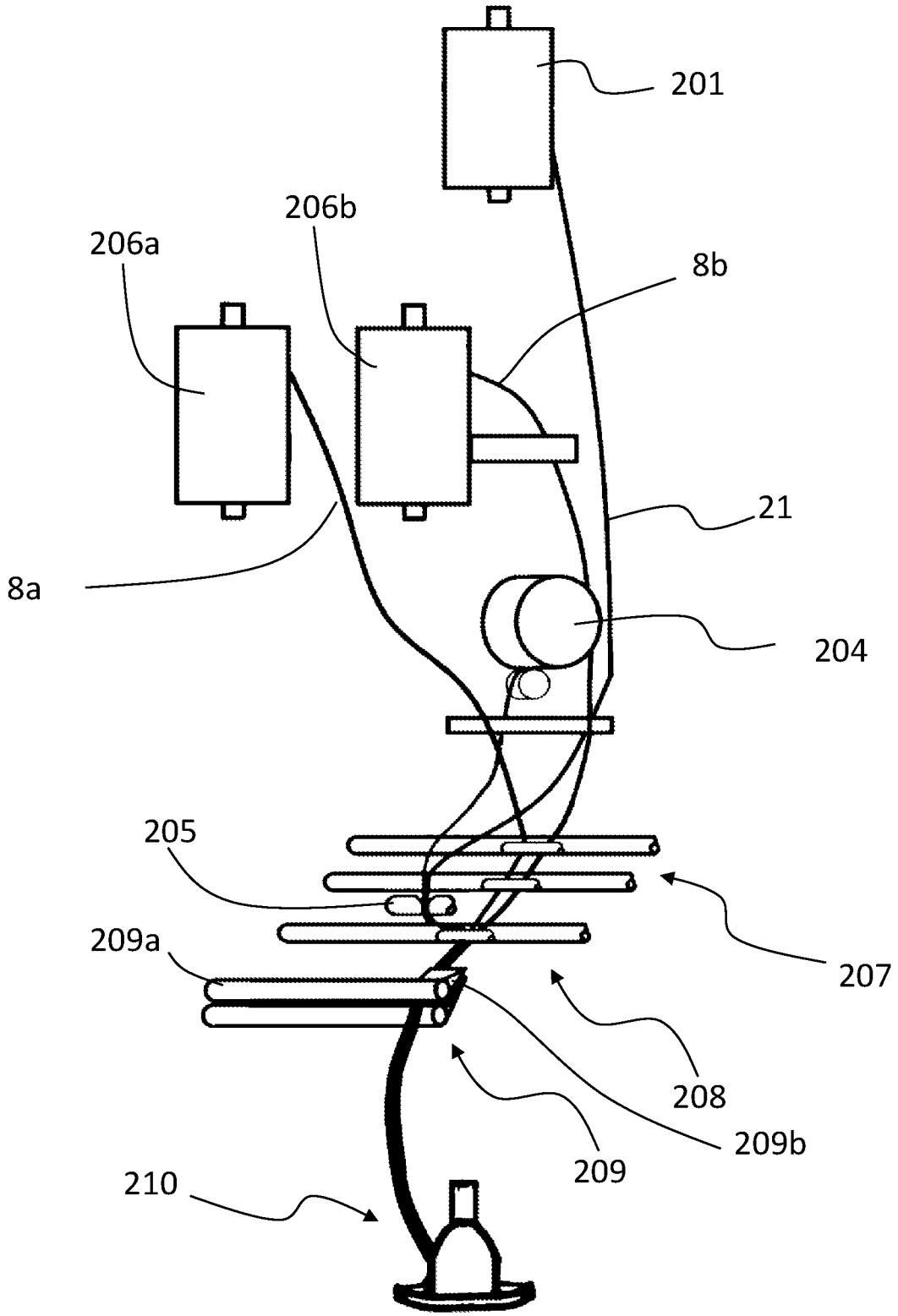

FIGS. 7 and 8 show another possible apparatus 200 and method for the production of a composite yarn 1 according to the present solution. In such an embodiment, the sheath 3 is made from two different rovings that, for part of their path, are treated separately, and subsequently combined to form the sheath. Similar methods are known in the art as "siro spinning". Further embodiment with a greater number of rovings are possible.

Core 2, comprises polyester filaments 21 and elastane as elastomeric filament 22. Polyester 21 comes from a bobbin 201, and is passed through a tube 202, where a first draft is applied. A further draft may be applied by rollers 203 at the exit of tube 202.

Elastane 22 comes from bobbin 204, and is guided to roller 205, where it is combined with polyester 21 to form the core 2. As an example, roller 205 may be of the kind shown in FIG. 3.

The sheath 3 is provided by two cotton rovings 8*a*, 8*b*, that come from spools 206*a*, 206*b*. Rovings 8*a*, 8*b* are drafted separately (as better shown in FIG. 8), e.g. by one or more draft rollers 207.

The core 2 is guided to draft rollers 208, where also cotton rovings 8*a*, 8*b* are fed.

The core 2 and the cotton rovings 8*a*, 8*b* are then spun by a spinning device 210.

Preferably, before the spinning device 210, the bundle of core 2 and rovings 8*a*, 8*b* is passed through a further drafting and compacting device 209, shown in an exemplary and preferred embodiment in the enlarged detail of FIG. 7. In this embodiment, the drafting and compact device 209 comprises two compact rollers 209*a*, between which the bundle of yarns 2, 8*a*, 8*b* (not shown for better clarity in the enlarged detail of FIG. 7) is pressed. Each compact roller 209 drives an endless belt 209*b*. The belts 209*b* are facing one another, to define a passage 209*c* for the bundle of yarns 2, 8*a*, 8*b* between the belts 209*b*. This kind of drafting and compacting device is known in the art as "double apron drafting system".

In general, the bundle of yarns 2, 8*a*, 8*b* is guided and pressed by the drafting and compact device 209 (e.g. in the passage 209*c* by the belts 209*b* in the shown embodiment), providing an even pressing and drafting of all the components of the bundle of yarns 2, 8*a*, 8*b*, i.e. polyester 21 and elastane 22 of the core 2 and the rovings 8*a*, 8*b* that form the sheath 3.

As before, the core 2 is drafted and guided in order to be centered with respect to the sheath 3 in the final yarn 1.

In other embodiments, the drafting and compacting device 209 may be omitted.

In addition, a possible embodiment provides that one of the two rovings 8*a*, 8*b* is omitted (or in any case not used), to carry out a single roving ring spinning of the composite yarn 1.

Figure 9:
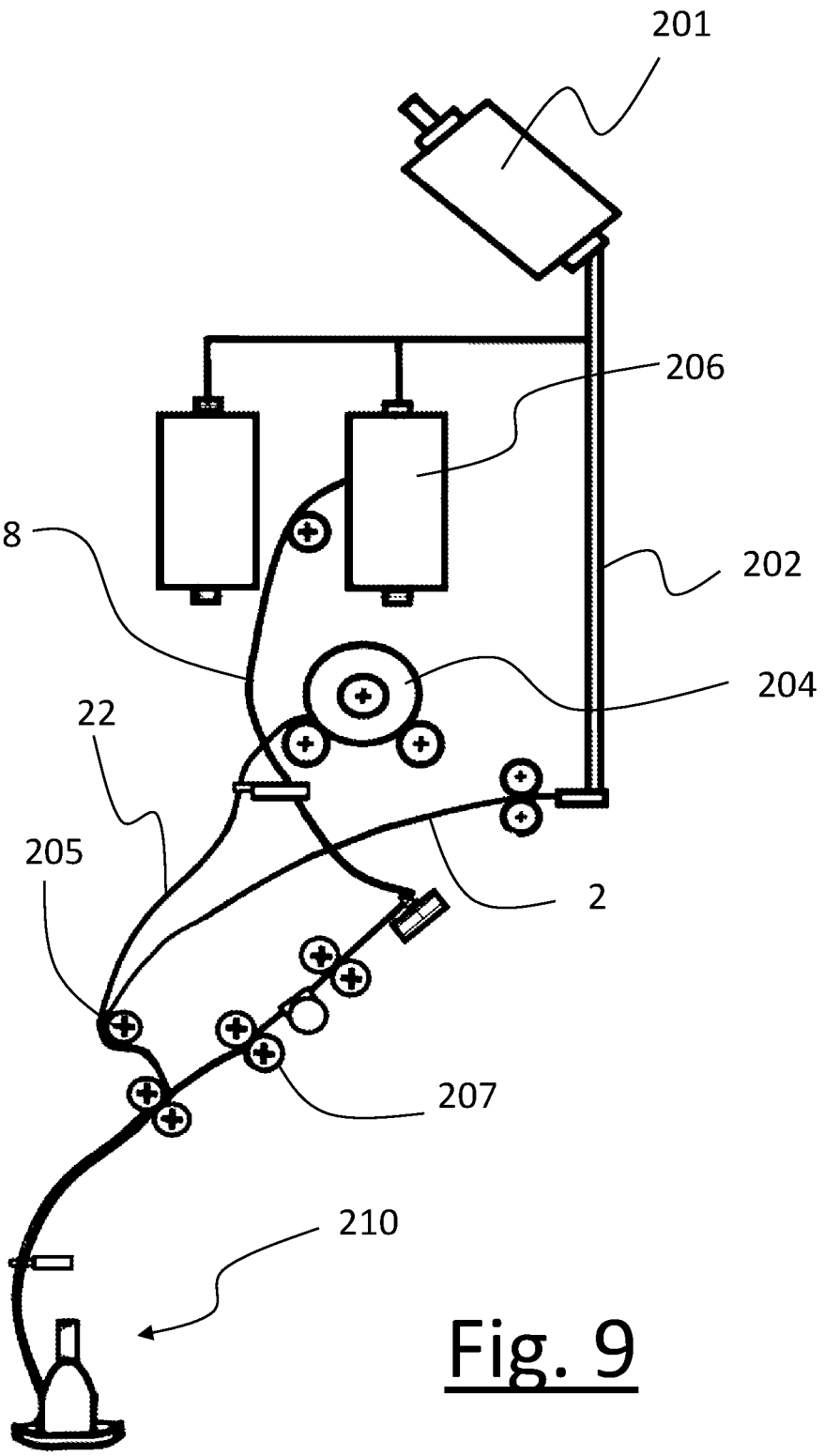
FIG. 9 shows a further possible embodiment of an apparatus for the production of an exemplary composite yarn according to the invention

As an example, FIG. 9 shows an embodiment of a ring spinning apparatus, provided with a single source 7 for roving 8, and without a compacting device 209. The other elements are similar to the ones of FIGS. 7 and 8 and are shown with the same numeral references.

The invention will now be further disclosed with reference to the following example.

Example 1

A fabric X was prepared using yarns according to the invention and a comparison yarn, Xcomp, was prepared using yarns according to the prior art. The composition of the sample weft yarns is recited in Table 1 under the Yarn Composition column. The composition of the warp yarns is the same as the composition of the weft yarns except that no elastane is present and the cotton amount is increased by the previously present elastane amount. The PES core in the yarns of X is a 150 denier bundle of core fibers formed by 36 filaments, each filament is a 4.5 denier filament.

Fabric trials were carried out to evaluate fabric tear and tensile strength. Tensile strength was tested with ASTM D5034, while standard ASTM D1424 was used to evaluate fabric tear.

The test results are summarized in the following table; As can be seen from the numbers in the following table, it is apparent that the fabric performance has increased by 20% or more.

TABLE 1

| | Yarn Composition | Tensile Strength Test (kg) ASTM D5034 | | Tear Strength Test (g) ASTM D1424 | |
|---|---|---|---|---|---|
| sample | (weight %) | Warp | Weft | Warp | Weft |
| X | 52% COTTON<br>44% POLYESTER<br>4% ELASTANE | 120.26 | 55.4 | 7040 | 4635 |
| Xcomp | 91.50% COTTON<br>2.50% ELASTAN<br>6% POLYESTER | 94.8 | 45.31 | 5880 | 4570 |

The invention claimed is:

1. A composite yarn (1) having a core (2) and a sheath (3), said sheath comprising staple fibers (3*a*) said core (2) comprising at least one polymeric core fiber (21), made of polymeric material, wherein the total amount of the core fibers (21) is at least 35% by weight of the total weight of the composite yarn (1), and wherein the core fiber (21) and the sheath (3) are spun together, wherein the core fibers (21) have a linear density of 14 denier or less, wherein the core fibers (21) are non-elastomeric filaments and the core comprises at least 12 core fibers, said core (2) further comprising a plurality of elastomeric filaments (22), the core fibers (21) and the plurality of elastomeric filaments (22) being connected together in a continuous way such that the core fibers and the plurality of elastomeric filaments are attached at a plurality of points, and wherein the core fibers are Drawn Textured Yarns (DTY) and the core fibers (21) and the elastomeric filaments (22) are intertwined such that the elastomeric filaments (22) are coiled about the core fibers (21).

2. The composite yarn (1) according to claim 1, wherein the core fibers (21) and the sheath (3) are spun together by ring spinning with one or more roving sources for the sheath.

3. The composite yarn (1) according to claim 2, wherein the amount of filaments having elastic properties is in the range of 1% to 60% of the total weight of the composite yarn (1).

4. The composite yarn (1) according to claim 1, wherein at least part of said core fibers (21) are provided as a bundle of core fibers or as a core yarn (20).

5. The composite yarn (1) according to claim 1, wherein the total amount of core fibers (21) is in the range of 35% to 90% by weight of the composite yarn (1).

6. The composite yarn (1) according to claim 1, wherein said core fibers (21) are made of materials selected from polyester polymers and copolymers, polyamide polymers, copolymers and mixtures thereof, said core fibers (21) comprising one or more of:

PET (polyethylene terephthalate) filaments;

PBT (polybutylene terephthalate) filaments;

PTT (Poly tri-methylene terephthalate) filaments;

PTMT (poly tetra-methylene terephthalate) filaments;

filaments made of copolymer of one or more of PET, PBT, PTT, PTMT;

PTT/PET bicomponent filaments,

PTT/PBT bicomponent filaments;

PTMT/PET bicomponent filaments.

7. The composite yarn (1) according to claim 1, wherein a twist multiple of the composite yarn (1) is in the range of 1.2 to 3.5.

8. A fabric (100) or an article (101) including the composite yarn (1) according to claim 1.

9. A method of preparing the composite yarn (1) according to claim 1, comprising the steps of:

providing a core (2) comprising a plurality of core fibers (21) made of polymeric material, and a plurality of elastomeric filaments (22);

providing a sheath (3) of inelastic staple fibers to cover said core (2), said sheath comprising staple fibers (3*a*); and spinning together said filaments and said staple fibers of the sheath (3);

wherein the total amount of said core fibers (21) is at least 35% by weight of the total weight of the composite yarn (1), wherein the core fibers (21) are drawn textured yarns having a linear density of 14 denier or less, wherein the core fibers are non-elastomeric filaments, wherein the core comprises at least 12 core fibers, wherein the step of providing includes the core fibers and the plurality of elastomeric filaments being connected together in a continuous way via a co-extrusion step in which they are forced through a restriction such that they remain attached at a plurality of points after exiting the restriction, and wherein the core fibers (21) and the elastomeric filaments (22) are intertwined such that the elastomeric filaments (22) are twisted about the core fibers (21) after said spinning step.

10. The method according to claim 9, wherein the core fibers (21) and the plurality of elastomeric filaments (22) are combined together before the spinning step.

11. The method according to claim 9, wherein the core (2) and the sheath (3), are combined by ring spinning.

12. The method according to claim 9, wherein the elastomeric filaments (22) are in a coiled orientation about the core (2).

13. The composite yarn according to claim 1, wherein the elastomeric filaments are drafted with a draft ratio between 1.5 to 5.5.

14. The method according to claim 9, wherein the elastomeric filaments are drafted with a draft ratio between 1.5 to 5.5 before being combined with the core fibers.

15. The method according to claim 14, wherein the core fibers are textured filaments drafted before being co-extruded with the drafted elastomeric filaments.

16. The composite yarn (1) according to claim 1, wherein a total count of said plurality of elastomeric filaments (22) comprises 20 to 240 den.

17. The composite yarn (1) according to claim 16, wherein a total count of the core (2) comprises 5 to 1000 den.

18. A method of preparing a composite yarn comprising:

providing a core (2) comprising a plurality of at least 12 core fibers (21) made of polymeric material, and at least one elastomeric filament (22), the plurality of core fibers (21) comprising Drawn Textured Yarns (DTY);

providing a sheath (3) of inelastic staple fibers to cover said core (2), said sheath comprising staple fibers (3*a*);

connecting together the core fibers (21) and the at least one elastomeric filament (22) in a continuous way via a co-extrusion step in which they are forced through a restriction in a tensioned state and remain attached at a plurality of points after exiting the restriction; and spinning together said core (2) and said staple fibers of the sheath (3), wherein the total amount of said core fibers (21) is at least 35% by weight of the total weight of the composite yarn (1), the core fibers (21) have a linear density of 14 denier or less and are non-elastomeric filaments, and the step of spinning together produces the core fibers (21) and the elastomeric filaments (22) being intertwined such that the elastomeric filaments (22) are coiled about the core fibers (21).

19. The method of claim 18, wherein said spinning produces said composite yarn having a twist multiple in a range of 1.2 to 3.5.

20. The method of claim 18, wherein a total count of said at least one elastomeric filament comprises 20 to 240 den.

21. The method of claim 20, wherein a total count of the core comprises 5 to 1000 den.

22. A composite yarn (1) having a core (2) and a sheath (3), said sheath comprising staple fibers (3*a*) said core (2) comprising at least one polymeric core fiber (21), made of polymeric material, wherein the total amount of the core fibers (21) is at least 35% by weight of the total weight of the composite yarn (1), and wherein the core fiber (21) and the sheath (3) are spun together, wherein the core fibers (21) have a linear density of 14 denier or less, wherein the core fibers (21) are non-elastomeric filaments and the core comprises at least 12 core fibers, said core (2) further comprising a plurality of elastomeric filaments (22), the core fibers (21) and the plurality of elastomeric filaments (22) being connected together in a continuous way such that the core fibers and the plurality of elastomeric filaments are attached at a plurality of points, and wherein the core fibers are Drawn Textured Yarns (DTY) and the composite yarn has a hairiness according to ASTM5647 between 5 and 20.

23. The composite yarn (1) according to claim 1, wherein the composite yarn has a hairiness according to ASTM5647 between 5 and 20.

* * * * *